US006550908B1

(12) United States Patent
Heitz et al.

(10) Patent No.: US 6,550,908 B1
(45) Date of Patent: Apr. 22, 2003

(54) PRINTING MODULE FOR TWO PRINTING SUBSTRATES AND DISTRIBUTORS EQUIPPED WITH MODULES OF THIS TYPE

(75) Inventors: Dominique Heitz, Nantes (FR); Jean-Michel Marchand, Casson (FR); Michel Monin, Ecouen (FR); Christophe Peynet, L'Hay les Roses (FR)

(73) Assignee: La Poste (Exploitant Public), Boulogne (FR)

( * ) Notice: Subject to any disclaimer, the term of this patent is extended or adjusted under 35 U.S.C. 154(b) by 0 days.

(21) Appl. No.: 10/111,955

(22) PCT Filed: Oct. 19, 2000

(86) PCT No.: PCT/FR00/02908

§ 371 (c)(1),
(2), (4) Date: Apr. 27, 2002

(87) PCT Pub. No.: WO01/30582

PCT Pub. Date: May 3, 2001

(30) Foreign Application Priority Data

Oct. 29, 1999 (FR) ..... 99 14006

(51) Int. Cl.[7] ..... B41J 2/01

(52) U.S. Cl. ..... 347/104

(58) Field of Search ..... 347/104, 101, 347/1; 400/578; 226/10; 399/361; 346/134; 271/6, 4.06, 4.09

(56) References Cited

FOREIGN PATENT DOCUMENTS

SE 8500911 8/1986

*Primary Examiner*—Raquel Yvette Gordon
(74) *Attorney, Agent, or Firm*—Patterson, Thuente, Skaar & Christensen, LLC

(57) ABSTRACT

A printing module includes a prism-shaped frame (8), two of its adjacent faces (10A, 10B) each defining a guiding path for a printing substrate (3A, 3B), the forward movement of the printing substrates being effected towards the extremity (11) of the two faces; two printing heads (30A, 30B) each placed on one of the paths; and bars (16A, 16B) for guiding and moving (20A–27A) each printing substrate on its path. Also relates to automatic distributors of printed or pre-printed substrates having printing modules of this type.

16 Claims, 5 Drawing Sheets

PRINTING MODULE FOR TWO PRINTING SUBSTRATES AND DISTRIBUTORS EQUIPPED WITH MODULES OF THIS TYPE

BACKGROUND OF THE INVENTION

1. Field of the Invention

The present invention concerns a printing module for at least two printing substrates, as well as distributors for these substrates or labels equipped with one or several printing modules.

2. Discussion of the Related Art

In a distributor, such as a label distributor, the function of this printing module shall be to issue two labels printed consecutively from both of the two printing substrates through a single distribution slit with preferably the possibility of also issuing pre-printed labels.

Up until now, the cost of a printing head, especially a thermic head, was high and the solution accordingly retained would consist of a mechanism comprising a single printing head and two different advance paths for the two printing substrates. This solution required a complicated system so as to alternatively bring the two printing substrates opposite the printing head.

OBJECTS AND SUMMARY OF THE INVENTION

The aim of the present invention is to offer another simpler solution regarding the forward movement and guiding of the printing substrates and based on the use of two printing heads with preferably the possibility of rendering each of them inoperative so as to have a simple distribution function of pre-printed substrates.

It concerns providing a printing module for at least two printing substrates, characterised in that it includes:

- a sensibly prism-shaped frame whose two adjacent faces each define a guiding path for one of the printing substrates, the forward movement of the printing substrates being made in the direction of the extremity common to the two faces;
- two printing heads each fitted on one of the paths; and
- means for guiding and moving each printing substrate in its advance path.

This prism-shaped configuration makes it possible in particular to successively guide the paper substrates through a single distribution slit. It also makes it possible to provide a common cutting element for the printing substrates placed downstream of the extremity of the frame where the printing substrates meet together. Thus, it is possible to replace the modules of existing distributors which originally comprised a single printing head. Preferably, each printing head can be lifted into an inoperative position so as to have a single distribution function.

Moreover, another advantage resides in the fact that the means for moving the printing substrates can be housed inside the frame, each printing head being able to be fitted on a removable head carrier placed opposite the outside of the frame and comprising means for fixing the latter.

According to another characteristic of the invention, the printing module can be loaded on at least one of its paths with adaptable printing substrates, each printing substrate for this purpose consisting of a succession of zones differentiated, for example, by their colour, each zone being able to be printed and/or cut so that the final substrate can consist of a single zone, of a number of these zones or of all these zones.

The printing module mentioned above has been designed in particular as part of a more general study related to automatic distributors for printing substrates printed in said distributors or preprinted, and the present invention thus also concerns these distributors.

According to the invention, such a distributor is thus characterised in that it comprises at least one of said printing modules.

In one advantageous embodiment, the distributor is a block constituted by a parallelpiped box having a facade door opening laterally, said door including a tactile keypad, a screen, means for cash payment and payment by card, and a distribution bowl, at least two modules being placed side by side and pointing downwards in the box so as to be directly accessible from the outside after opening of the door and to communicate at the outlet with said bowl in the door.

For postal applications in particular, the distributor can be provided with scales embedded in its upper wall for providing franking labels.

DESCRIPTION OF THE DRAWINGS

The present invention and its other advantages shall be more readily understood from a reading of the following description of an embodiment example with reference to the drawings on which.

DESCRIPTION OF THE PREFERRED EMBODIMENTS

Figure 1:
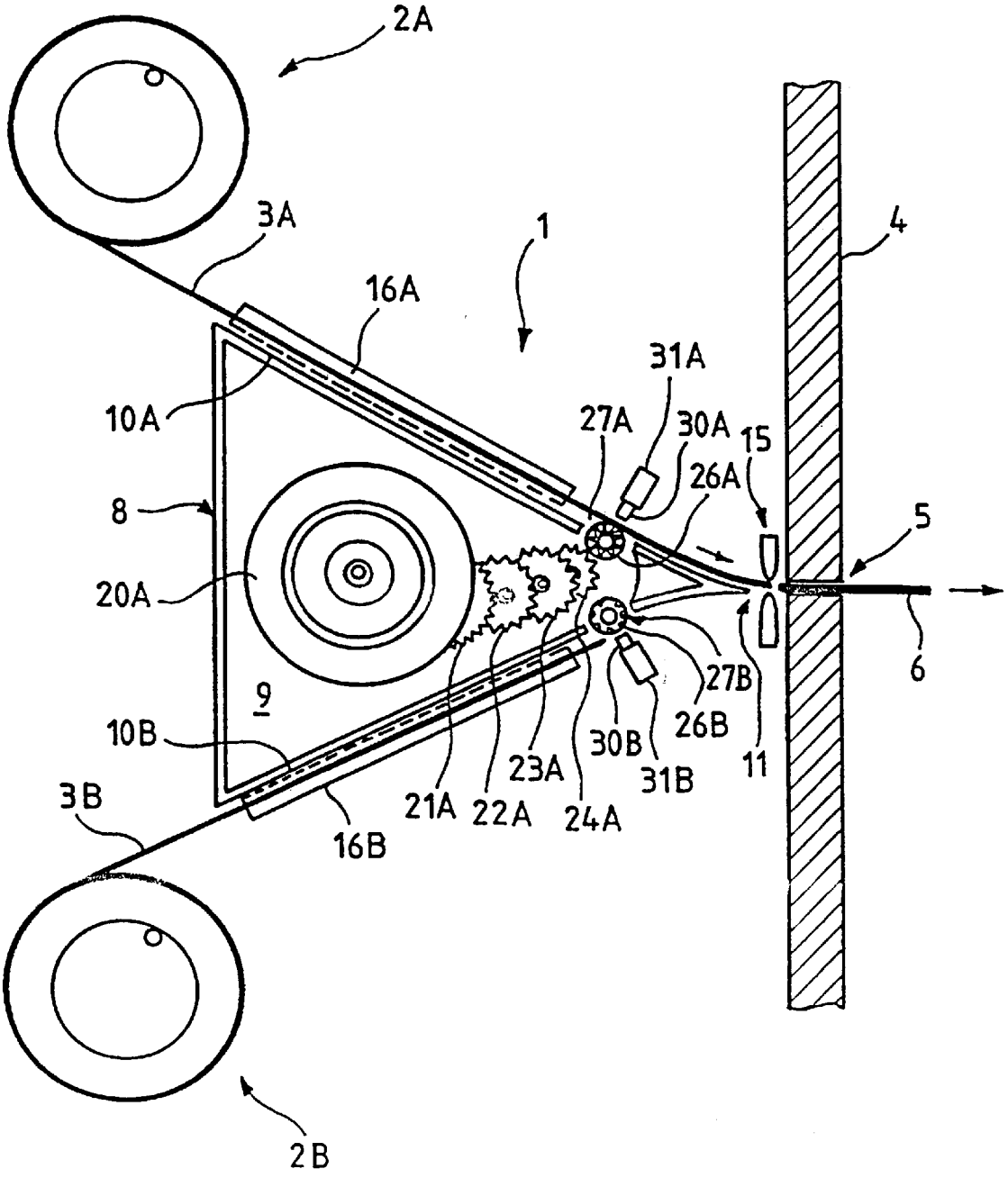
FIG. 1 diagrammatically shows a side view of the functional elements of the module of the invention.
Figure 2:
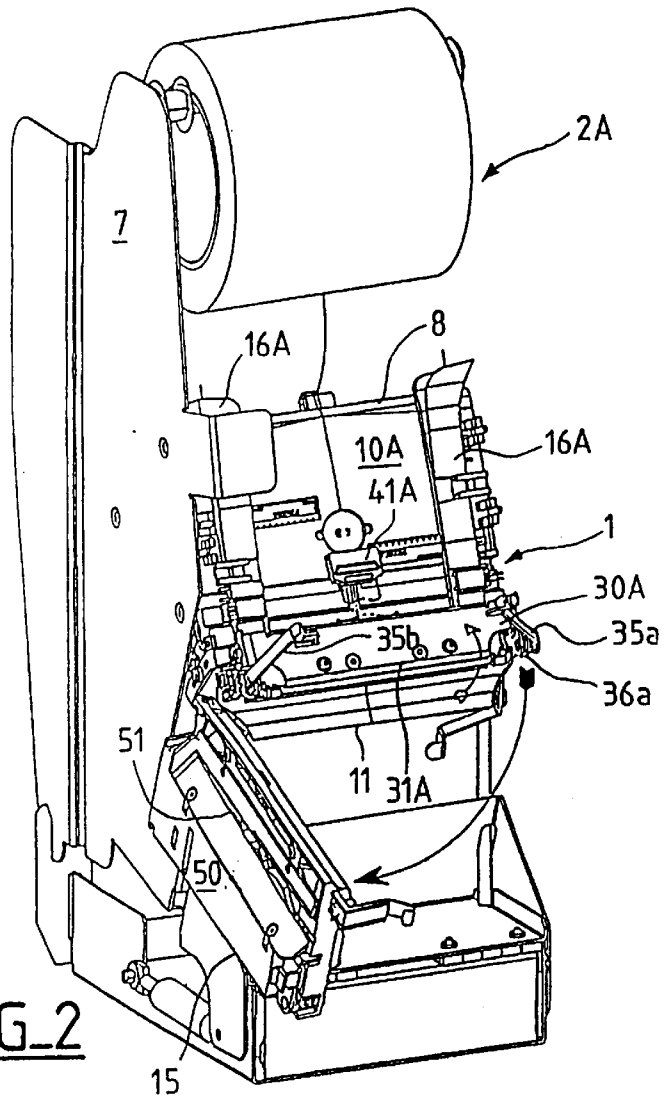
FIG. 2 is a perspective three-quarters front view showing the module according to one embodiment, installed on a distributor frame and the press-cutter in an open position.

FIG. 1 diagrammatically represents sideways the functional elements of the printing module 1 of the invention, as well as the two distribution rollers 2A and 2B, each provided for one printing substrate, respectively 3A, 3B, and the front wall 4 of a distributor provided with a distribution slit 5. The distribution rollers 2A, 2B are secured to the frame 7 of the distributor (see FIG. 2). According to the instructions of a central unit, this distributor issues consecutively printed labels 6 on the substrate 3A or on the substrate 3B through a single distribution slit 5.

Figure 3:
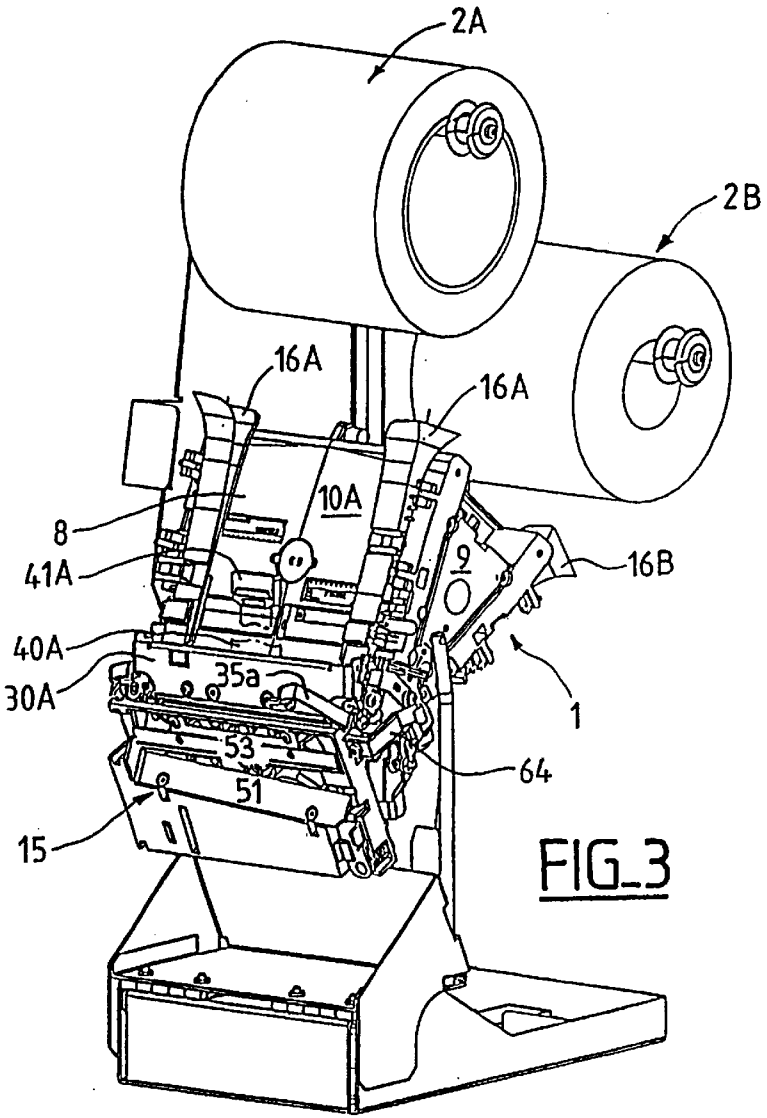
FIG. 3 is a view similar to FIG. 2, but showing the module from the other side with respect to FIG. 2 and in which the press-cutter is in the closed operating position
Figure 4:
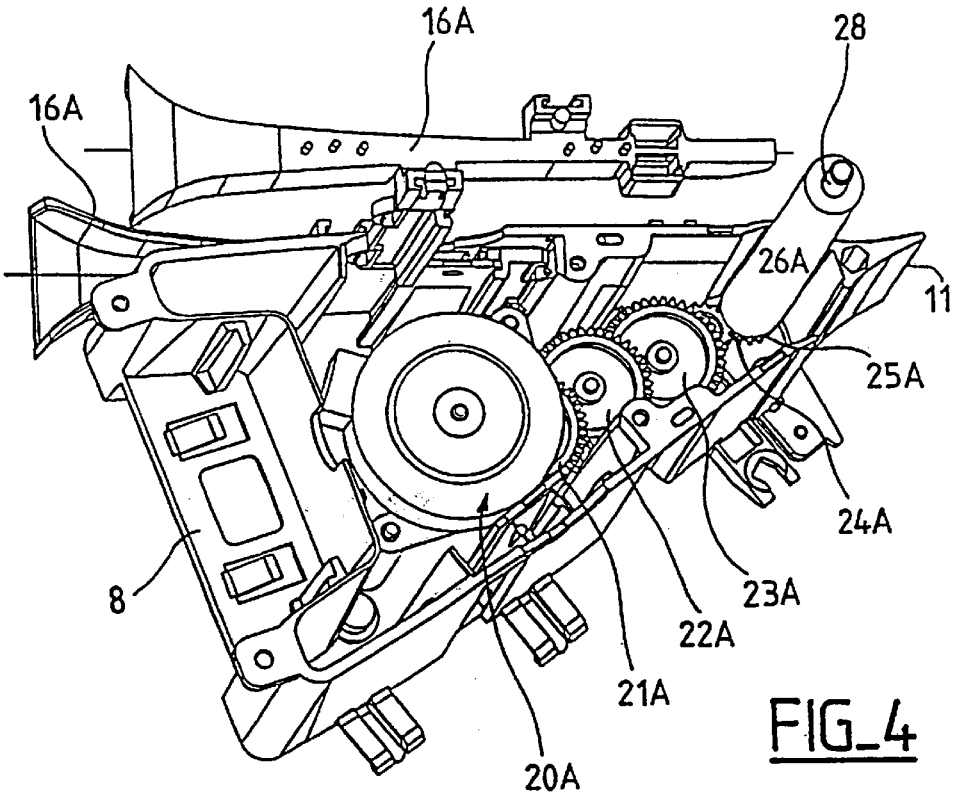
FIG. 4 is a lateral perspective view of the module with certain elements not shown, and showing in particular the means for driving one the printing substrates.

According to the invention, the printing module 1 is characterised by an approximately prism-shaped frame 8 whose base 9 here is triangular and extends into the plane of FIG. 1. Two of the faces of the prism, given the references 10A and 10B and which are adjacent, are each used as a path for respectively guiding the printing substrate 3A and 3B, the two paths meeting together at the common extremity 11 of these two faces opposite the slit 5 of the distributor. The slanting of the faces 10A, 10B at the level of the extremity 11 with respect to their median plane is less steep than in the remainder of the frame 8 so as to minimise the size of the frame 8 and guide as best as possible the printing substrates opposite the slit 5 of the distributor. The module 1 includes downstream of the frame 8 a press-cutter 15 used for cutting the printing substrates which appear on distribution. This press-cutter shall be described later in detail. By known means not described in detail in this text, each printing substrate 3A, 3B is laterally guided by guiding bars 16A, 16B having a U-shaped section and widened at the inlet extremity of the printing substrate and able to be adjusted transversally so as to be adapted to the width of the printing substrate (see also FIGS. 3 and 4).

Drive means are housed in the frame 8 of the module, said means being independent for each printing substrate 3A, 3B and including for the printing substrate 3A a step motor 20A gearing a set of toothed demultiplication pinions 21A, 22A, 23A and 24A, the latter gearing in turn with the extremity portion 25A (see also FIG. 4) of a drive roller 26A having an external drive surface made of an antiskid material intended to come into contact with the printing substrate. To this effect, the frame 8 of the module comprises a positioning window 27A for the roller 26A so that its drive surface is elevated with respect to the face 10A of the frame 8 so as to therefore be able to effectively drive the printing substrate 3A. The toothed pinions and the step motors are mounted on sprockets or spindle ends provided projecting onto the wall forming the base 9 of the frame 8. Similarly, the drive roller 26A comprises at each of its extremities a spin axis (such as 28 on FIG. 4) guided in a corresponding perforation of the frame 8. The motor 20A is adapted so as to make the printing substrate 3A move forward or backward on its guiding path according to instructions received from the central control unit of the distributor.

For driving the printing substrate 3B, similar drive means (not shown on the figures) are provided placed symmetrically with respect to a median plane parallel to the plane of FIG. 1 on the triangular wall opposite the wall 9 of the frame 8 and adapted to drive a drive roller 26B, also provided in a positioning window 27B (see FIG. 1).

According to the invention, each printing substrate 3A, 3B is provided with a thermic printing head respectively 30A, 30B of the desired width secured to a movable head carrier 31A, 31B and positioned opposite the associated drive roller 26A, 26B so that the roller also forms an anvil at the moment of printing by the printing head.

Figure 6A:
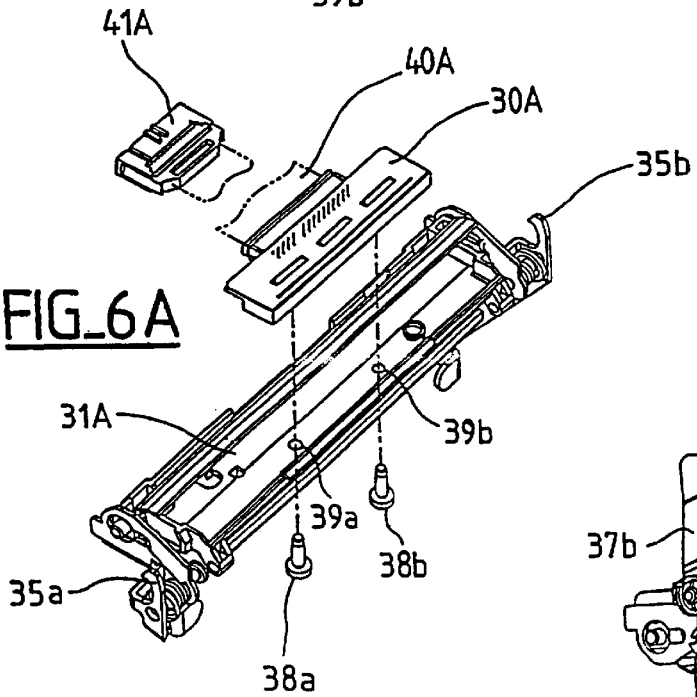
FIG. 6A is a perspective view seen from below showing an exploded view of the fixing of the printing head on the printing carrier.
Figure 6B:
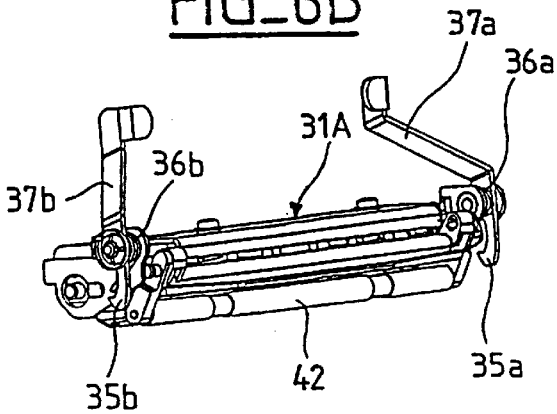
FIG. 6B is a perspective front view of the printing head carrier of FIG. 5A showing the free drive roller in a lifted up position.
Figure 6C:
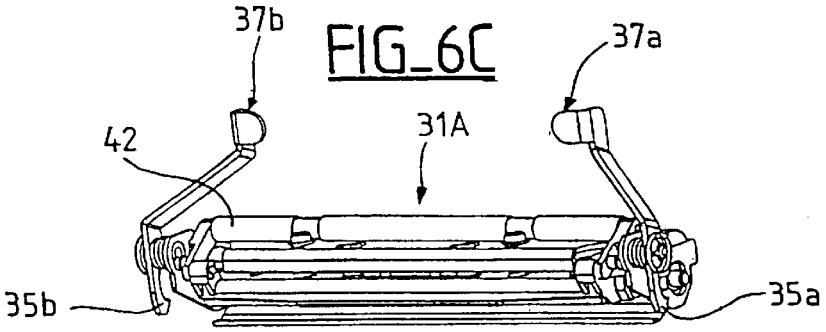
FIG. 6C is a rear perspective view of the printing head carrier showing its free drive roller in an operating position.

As shown in more detail on FIGS. 6A–6C showing in particular by way of example the head carrier 31A, the latter is movable and can be laterally secured to the triangular walls 9 of the frame 8 with the aid of two lateral locking hooks 35*a*, 35*b* cooperating with notches of the frame 8 provided to this effect (not visible on the figures). A spring 36*a*, 36*b* continuously biases the corresponding hook 35*a*, 35*b* in its hooking position, the hooks being extended by manoeuvre arms 37*a*, 37*b* which can be rendered integral with each other.

The thermic printing head 30A is fixed to its carrier with two fixing screws 38*a*, 38*b* engaged in perforations 39*a*, 39*b* of the head carrier 31A and in threadings of said head. Linking to the control unit of the distributor is effected with the aid of a flexible connection strip 40A and a connector 41A placed on the face 10A of the frame 8 (see FIGS. 2 and 3).

The head carrier 31A, 31B is moreover equipped with a free drive roller 42 and a mechanism for placing the roller in a functioning position in which it comes into contact with the printing substrate and exerting pressure against the roller 26A, 26B rendering the head inactive, or in an inverted lifted up position in which the head is active. The mechanism for passing from a "presser" mode to a "printing" mode includes two small springs adapted so as to keep the roller in either of these positions. It is thus possible to move simply to the "presser" mode without having to dismantle the printing head so as, for example, to issue a preprinted label.

Figure 5A:
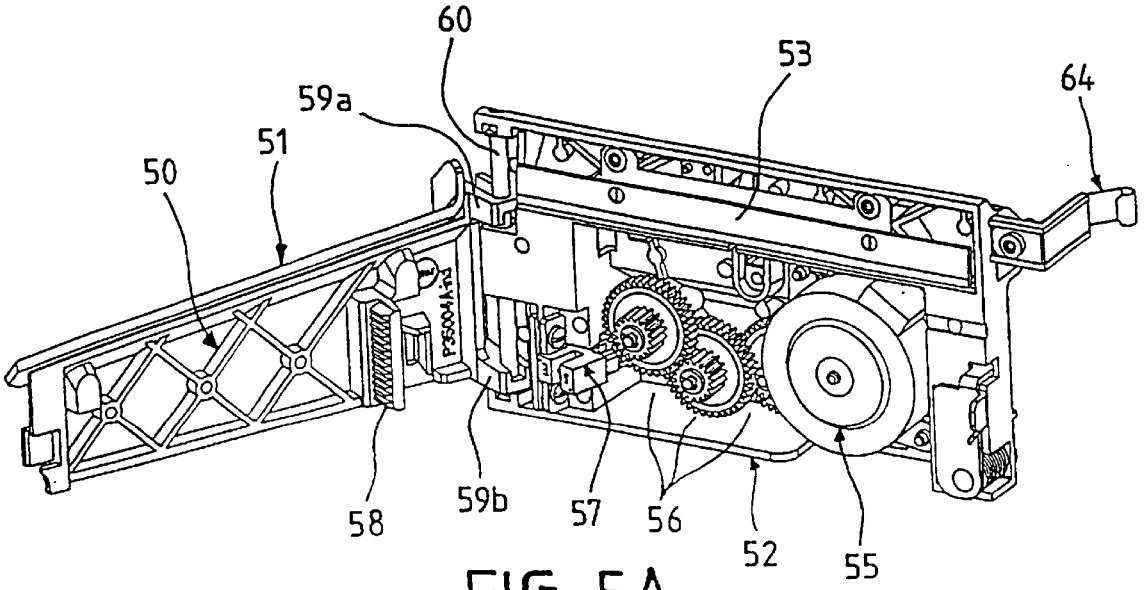
FIG. 5A is a perspective view of the press-cutter of the module of the invention in an open position.
Figure 5B:
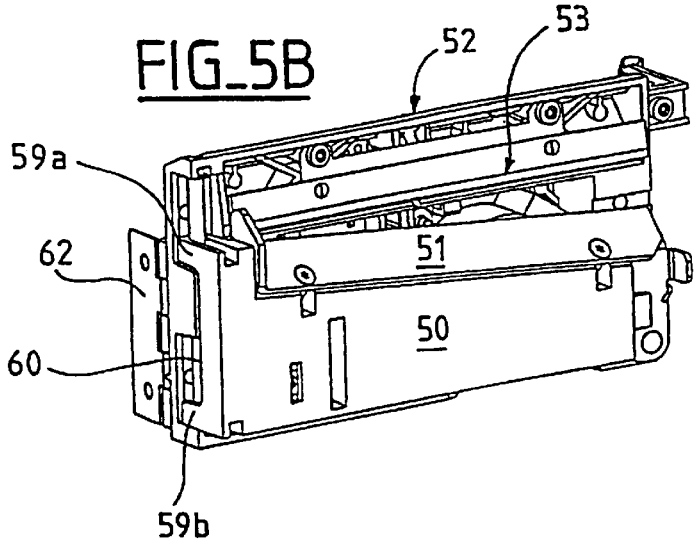
FIG. 5B is a perspective view of the press-cutter of FIG. 5A in the closed operational position.

The pressing-cutter 15 shown on FIGS. 5A and 5B comprises a mobile front wall 50 fitted with a blade 51 and a box 52 provided with a fixed counter-blade 53 and closing an adapted motorised mechanism for moving in translation the wall 50 so as to cut the printing substrate 3A or 3B. This mechanism includes a step motor 55 receiving operating instructions from the control unit of the distributor and successively gearing toothed pinions 56 which cooperate with a rack 58 integral with the mobile front wall 50. Detection means 57 are also provided in the box 52 for detecting the presence of the printing substrate and triggering the cutting operation via the central control unit. The translation movement of the wall 50 is guided by two hinge elements 59*a*, 59*b* each having a perforation which cooperates with a lateral hinge pin 60 belonging to the box 52. This hinge pin 60 has a circular section, also used as a spin axis for the wall 50 with respect to the box 52 and thus making it possible to have access to the motorised mechanism. Located at the extremity opposite the hinge pin 60 are means for closing, for example by clipsage, the wall 50 on the box 52. The pressing-cutter 15 is mounted on the module 8 with the aid of a hinge 62 (see FIG. 5B) also laterally secured to the box 52 on the side of the hinge pin 60. A locking arm 64 cooperating with a suitable element placed laterally on the triangular base of the frame 8 serves to lock the pressing-cutter 15 in a closed operating position. The open position shown on FIG. 2 facilitates access to the elements of the printing module, especially so as to move from the "printing" mode to the "presser" mode of the printing carrier 31A, 31B.

The device functions as follows. The central control unit sends an instruction, for example to the step motor 20A, so as to make the printing substrate 3A move forward by means of the drive means 22A–26A. The printing substrate shall advance until it is located opposite the printing head 30A. This head then receives a printing instruction. The drive means 22A–26A then make the printed substrate 6 move forward into the distribution slit 5 and an instruction is given to the motor of the pressing-cutter 15 so as to lift up the blade 51. So as to consecutively issue a printed label originating from the printing substrate 3B, the central unit shall initially order the backward movement of the printing substrate 3A up to the level of the printing head 31A and then order the same procedure as above for the substrate 3B. It is to be noted that for the control of forward and backward movements of the printing substrate in the modules, a transmissive type optical sensor is advantageously provided on at least one of the guiding bars 16A, 16*b* so as to control the presence of the printing substrate and read from this the movements by cooperating with a suitable lateral removing of the latter making variations of the light transmission factor appear.

Figure 7A:
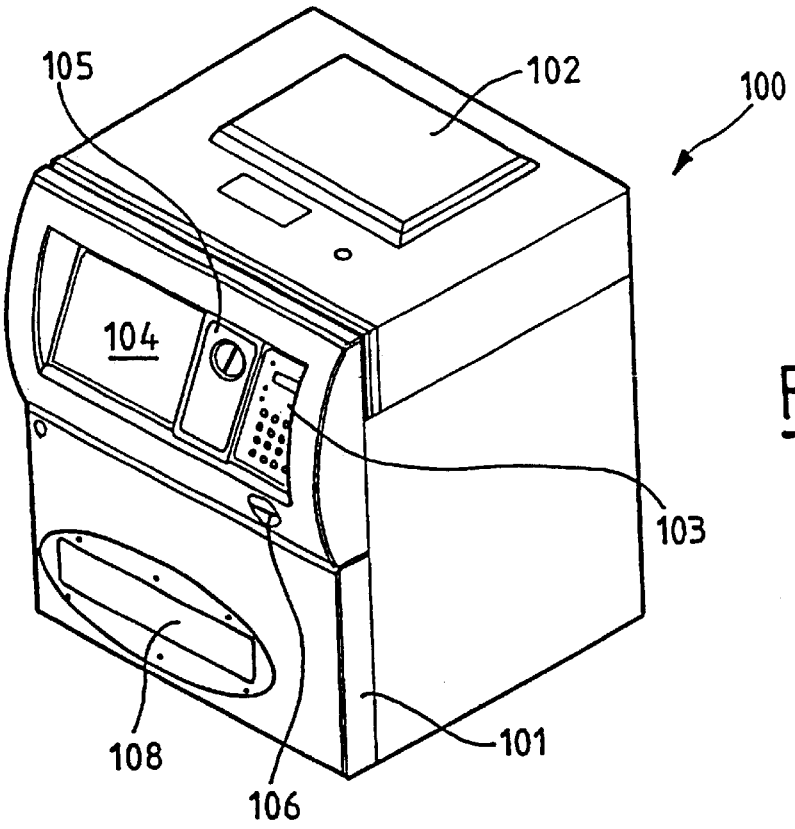
FIGS. 7*a* and 7*b* are perspective views representing a given automatic distributor according to the invention and having its facade in a closed and open position, respectively.
Figure 7B:
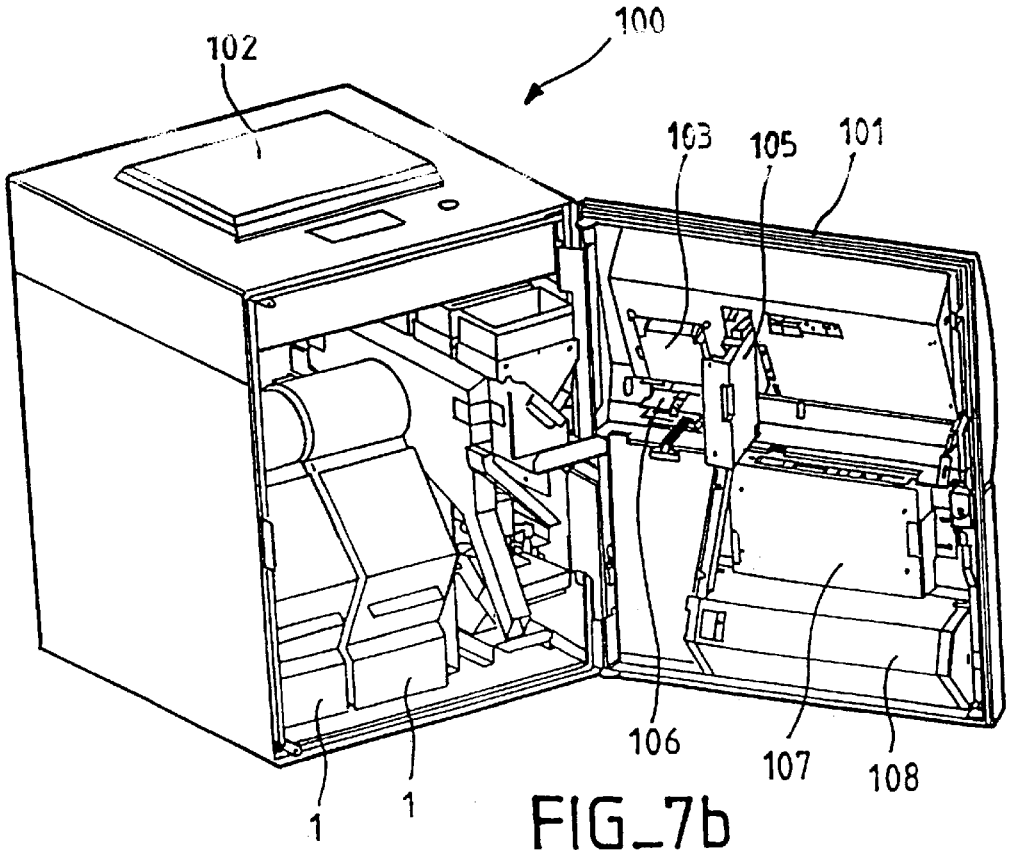

FIGS. 7A and 7B represent a distributor according to the invention, namely more specifically a printing and distribution device whose role is to automatically offer customers a plurality of different services within a restricted volume.

This device appears in the form of a compact block 100 whose dimensions may be about 60 cm as regards its width and depth and about 70 for its height. In the form represented, this concerns a printing and distribution block intended in particular to equip a post office and able to provide for example and selected from a wide range of possibilities franking labels, stamp printing blocks, tickets for shows and receipts for bank card payments.

The block 100 consists of a parallepiped box with a facade door 101 hinged laterally and a pair of scales 102 embedded in the upper wall.

Mounted at the upper portion of the door 101 are a keypad 103 and a tactile screen 104 available for programming according to the selected services and customers, a coin machine 105, a bank card reader 106, a control unit 107 and at the lower portion a distribution bowl 108.

In accordance with the invention, the block 100 includes in its internal volume two printing modules of the type described above and accordingly designated by the same reference 1 as in the preceding figures, said modules 1 being placed side by side pointed downwards and both communicating at the outlet with the single bowl 108.

The modules 1 are placed so as to be directly accessible from the outside after opening of the door 100, FIG. 7B and to this effect they are advantageously mounted pivoting in their lower portion so as to be able to be tilted outwardly so as to allow full accessibility to each of their paper paths after lifting up of the corresponding printing head carrier.

The block 100 can therefore be loaded with four different substrates which appear in the form of a paper roll or a silicon/paper complex.

The block 100 can print blank substrates or partially preprinted substrates following which the latter are press-cut and transferred into the bowl 108.

For preprinted substrates such as stamp blocks, the block 100 can also provide a simple distributor function, the printing head carrier 31A, 31B of the corresponding paper path then being tilted so as to render active the press roller 42 instead of the printing head 30A, 30B, this operation being able to be carried out manually during loading of the preprinted substrate roller.

An adaptable printing substrate design makes it possible to further increase the multiplicity of the services offered to customers by a printing and distribution block according to the invention. Each printing substrate can thus comprise a succession of zones or bands possibly differentiated by their colour, for example a central white zone between lower and upper blue and red bands. As each zone or band can be printed and cut, the final supports to be issued to customers can consist of a single band or even of the median band plus one of the lower or upper bands or even all three of the bands. The bands needing to be eliminated can receive a marking indicating they are to be deleted.

This adaptable substrate can be provided as a label for postal parcels so as to receive in its central zone a code for automatic reading, such as a bar code, whereas an adjacent coloured band is intended for manual processing.

Finally, in the case where the printing blocks 1 are equipped with thermic printing heads, another differentiation parameter can be made use of, this here concerning the printing colour (for example black or red) which can be selected with suitable paper by varying their runoff speed.

Of course, the printing and distribution block of the invention can distribute several supports in a given operation, for example a block of stamps and/or a franking label with a bank card payment receipt.

It goes without saying that embodiment variants are possible, especially in the printing modules where the printing heads can be housed in the frame of the module and the drive means disposed accordingly, meaning that moreover the invention is not limited to the thermic printing heads.

What is claimed is:

1. Printing module (1) for at least two printing substrates (3A, 3B), characterised in that it includes:

an approximately prism-shaped frame (8) whose two adjacent faces (10A, 10B) each define a guiding path for one of the printing substrates, the forward movement of the printing substrates being effected in the direction of the extremity (11) of the two faces;

two printing heads (30A, 30B) each fitted on one of the paths, and guiding means (16A, 16B) and drive means (20A–27A) for each printing substrate on its forward movement path.

2. Module according to claim 1, characterised in that means (15) are provided downstream of the printing heads so as to consecutively cut one of the printing substrates.

3. Module according to claim 1, characterised in that the cutting means are constituted by a pressing-cutter (15) mounted with the aid of a hinge (62) on the frame (8) enabling it to adopt an open position and a closed operating position.

4. Module according to claim 2, characterised in that the cutting means (154) include means (57) for detecting the presence of the printing substrate.

5. Module according to claim 1, characterised in that it includes thermic printing heads.

6. Module according to claim 1, characterised in that each of the printing heads can be lifted up separately into an inactive position.

7. Module according to claim 1, characterised in that the drive means (20A–27A) are housed inside the frame (8) and constituted for each printing substrate (3A, 3B) by a drive roller (26A, 26B) intended to come into contact with the printing substrate and geared by a system of toothed pinions (21A–24A) driven by a step motor (20A).

8. Module according to claim 7, characterised in that each printing head (30A, 30B) is placed opposite the outside of the frame (8), each drive roller (27A, 27B) being placed opposite the associated printing head so as to also form an anvil for said head.

9. Module according to claim 1, characterised in that each printing head (30A, 30B) is mounted on a movable head carrier (31A, 31B) comprising means (35*a*, 35*b*) for fixing to the frame (8).

10. Module according to claim 9, characterised in that the head carrier comprises a rotary free roller (42) able to adopt a first functioning position in which said roller is in contact with the printing substrate, the printing head then being inactive, and a second lifted up position in which said roller is not in contact with the printing substrate, the printing head then being active, and means for positioning said roller in either of these positions.

11. Module according to claim 1, characterised in that it is loaded on at least one of its paths with adaptable printing substrates, each printing substrate consisting to this effect of a succession of differentiated zones, each zone being able to be printed and/or cut so that the final support can consist of a single zone, less than all these zones or all these zones.

12. Module according to claim 11, characterised in that said zones of said adaptable printing substrate are differentiated by their colour.

13. Automatic printing substrate distributor, characterised in that it includes at least one printing module (1) according to claim 1.

14. Distributor according to claim 13, characterised in that it consists of a block (100) with a facade door (101 opening laterally, said door (101) including a tactile keypad (103), a screen (104), means (105, 106) for card and cash payments, and a distribution bowl (108), at least two modules (1) being placed side by side and pointed downwards in the box so as to be directly accessible from the outside after opening of the door (101), and to communicate at the outlet with the bowl (108) in the door (101).

15. Distributor according to claim 14, characterised in that said printing modules (1) are mounted pivoting at their lower portion so as to be able to be tilted outwardly so as to allow accessibility to reach of their two paper paths.

16. Distributor according to claim 13, characterised in that it further comprises a pair of scales (102) embedded in its upper wall.

* * * * *